US005435824A

United States Patent [19]

Dorsch et al.

[11] Patent Number: 5,435,824

[45] Date of Patent: Jul. 25, 1995

[54] HOT-ISOSTATICALLY-COMPACTED MARTENSITIC MOLD AND DIE BLOCK ARTICLE AND METHOD OF MANUFACTURE

[75] Inventors: Carl J. Dorsch; Kenneth E. Pinnow, both of Pittsburgh; William Stasko, West Homestead, all of Pa.

[73] Assignee: Crucible Materials Corporation, Syracuse, N.Y.

[21] Appl. No.: 126,551

[22] Filed: Sep. 27, 1993

[51] Int. Cl.[6] ..... C22C 29/00; B22F 3/15

[52] U.S. Cl. ..... 75/231; 75/243; 75/246; 419/10; 419/28; 419/29; 419/49

[58] Field of Search ..... 419/28, 29, 49, 10; 75/231, 230, 243, 246

[56] References Cited

U.S. PATENT DOCUMENTS

| | | | |
|---|---|---|---|
| 4,052,230 | 10/1977 | Aylward | 148/2 |
| 4,121,930 | 10/1978 | Yukawa et al. | 75/238 |
| 4,140,527 | 2/1979 | Kawai et al. | 75/244 |
| 4,160,066 | 7/1979 | Szumachowski et al. | 428/683 |
| 4,880,461 | 11/1989 | Uchida | 75/238 |
| 5,238,482 | 8/1993 | Stasko et al. | 75/338 |
| 5,312,475 | 5/1994 | Purnell et al. | 75/231 |

FOREIGN PATENT DOCUMENTS 0545884 6/1993 European Pat. Off. .

OTHER PUBLICATIONS

Pinnow et al., "P/M Tool Steels" Metals Handbook, vol. 1, 10th Ed.: Properties and Selection (1989).

Cocks, D. J., "Longer Die Life from H13 Die Casting Dies by the Practical Application of Recent Research Results" ADCI TechData No. 01-88-01D (1988).

Wallace et al., "Influence of Cooling Rate on the Microstructure and Toughness of Premium H-13 Die Steels" 15th Die Casting Congress & Exposition, Oct. 16-19, 1989, St. Louis, Mo., Paper No. G-T89-013.

Dorsch et al., "The Effects of EDM on the Surface of Hardened H-13 Die Components" 15th Die Casting Congress & Exposition, Oct. 16-19, 1989, St. Louis, Mo., Paper No. G-T89-031.

Du et al., "The Effects of Sulfur Content on the Performance of H-13 Steel" Die Casting Research Foundation, Inc., Techdata Digest No. 01-83-01D.

*Primary Examiner*—Ngoclan T. Mai

*Attorney, Agent, or Firm*—Finnegan, Henderson, Farabow, Garrett & Dunner

[57] ABSTRACT

A martensitic hot work tool steel mold and die block article for use in the manufacture for molds for plastic injection molding, die casting die components, and other hot work tooling components. The article has a hardness within the range of 35 to 50 HRC, a minimum Charpy V-notch impact toughness of 3 foot pounds when heat treated to a hardness of 44 to 46 HRC and when tested both at 72° F. and 600° F. The article is an as hot-isostatically-compacted, fully dense, heat-treated mass of prealloyed particles which contain sulfur within the range of 0.05 to 0.30 weight percent. The hot work tool steel includes maraging and precipitation-hardening steels of this type.

14 Claims, 9 Drawing Sheets

HOT-ISOSTATICALLY-COMPACTED MARTENSITIC MOLD AND DIE BLOCK ARTICLE AND METHOD OF MANUFACTURE

BACKGROUND OF THE INVENTION

1. Field of the Invention

The invention relates to a highly machinable, hot-isostatically-compacted, prehardened, martensitic steel article used for molds for plastic injection molding, metal die casting die components, and other hot work tooling components, and to a method for producing the same.

2. Discussion of the Related Art

Typically, molds for plastic injection molding, components for die casting dies, hot forging dies, extrusion dies, and other hot work tooling, henceforth referred to as molds and dies, are manufactured by rough machining the component close to finish dimensions from a hot work tool steel mold or die block, hardening the rough-machined component by a quenching and tempering type of heat treatment, and finally machining the hardened component to finish dimensions. During the heat treatment process, dimensional changes occur in the rough-machined component as a result of metallurgical phase changes in the mold or die block, and as a result of nonuniform thermal stresses which are inherent in the heat treatment process. These dimensional changes cause the need for a second, finish machining operation to be performed after heat treatment to machine the component to its final shape and dimensions. The required second machining operation results in increased costs and manufacturing time in the construction of a mold or die.

The use of a prehardened mold or die block eliminates the need for a second, finish machining operation. Prehardened mold and die blocks made from conventional, resulfurized, AISI H13 hot work tool steel are currently available. The sulfur additions in the steel make it machinable at the high hardness needed for mold and die applications (35 to 50 HRC), but components manufactured from the currently available, prehardened mold and die blocks exhibit low toughness and reduced service life because the sulfur addition reduces the notch toughness of the steel. In addition, the sulfide particles which form in the steel degrade the ability of a mold block to be polished to the high-quality surface finish that is required in many plastic injection molding applications.

Because of the low notch toughness and reduced polishability exhibited by the currently available, prehardened mold and die blocks, their use is not widespread in the plastic injection molding and hot work tooling industries. Their low notch toughness is a significant disadvantage that reduces their usage because of the high costs and safety hazards incurred if a mold or die fractures during service. Thus, the potential industry-wide cost savings which could result from the use of highly machinable, prehardened die and mold blocks is not realized. A need therefore exists for highly machinable, prehardened, martensitic tool steel mold and die blocks that can be used without sacrificing tooling performance and longevity.

Additional cost savings can be realized by manufacturing mold and die blocks from hot-isostatically-compacted compacts of prealloyed powder of suitable chemical compositions. Such compacts are manufactured by placing the prealloyed powder into appropriate containers, sealing the containers with an air-tight seal, and then subjecting the containers to various combinations of high temperature and pressure. Because compacts so produced achieve 100 percent of theoretical density, there is no need for additional thermomechanical treatments such as hot forging, hot rolling, or hot extrusion to manufacture the mold and die blocks. Elimination of these thermomechanical treatments results in substantial savings in costs, manpower, and energy usage in the manufacture of prehardened mold and die blocks.

In addition, the production of prehardened mold and die blocks by heat treatment of hot-isostatically-compacted compacts results in unique metallurgical and mechanical properties in the mold and die blocks so produced. Specifically, because there is no plastic deformation from subsequent thermomechanical treatments, second-phase particles which form in the steel remain essentially spherical and there is no elongated grain structure in the steel parallel to a hot working direction. These features result in mechanical properties which are essentially isotropic, which in turn eliminate the need for mold and die manufacturers to judiciously choose the orientation of the steel to anticipate the orientation of stresses in the finished mold or die component.

Further, by producing prehardened mold and die blocks by hot isostatic compaction, without additional thermomechanical treatments, near-net-shape mold and die blocks can be manufactured. Custom-shaped containers can be fabricated to produce a mold or die block of a specific shape that minimizes the need for extensive machining after hot isostatic compaction and heat treatment. This further reduces the costs, manpower, and energy requirements in the manufacture of mold and die components.

OBJECTS OF THE INVENTION

It is a primary object of the present invention to provide a highly machinable, hot-isostatically-compacted, prehardened, martensitic hot work tool steel mold and die block which may be used to manufacture molds for plastic injection molding, die casting die components, and other hot work tooling components having an improved combination of impact toughness and polishability.

Another related object of the invention is to provide a method for producing a highly machinable, hot-isostatically-compacted, prehardened, martensitic hot work tool steel mold and die block having these characteristics by hot isostatic compaction and heat treatment of prealloyed powder which contains intentional additions of sulfur.

SUMMARY OF THE INVENTION

In accordance with the invention there is provided an as hot-isostatically-compacted, martensitic hot work tool steel mold and die block article that is adapted for use in the manufacture of molds for plastic injection molding, die casting die components, and other hot work tooling components. The article has a hardness within the range of 35 to 50 HRC, and a minimum transverse Charpy V-notch impact toughness of 5 foot pounds when it contains sulfur in the range of 0.05 to 0.20 weight per cent, when heat treated to a hardness of 44 to 46 HRC, and when tested at both 72° F. and 600° F. The article has a hardness within the range of 35 to 50 HRC, and a minimum transverse Charpy V-notch impact toughness of 3 foot pounds when it contains sulfur in the range of 0.21 to 0.30 weight per cent, when heat treated to a hardness of 44 to 46 HRC, and when tested at both 72° F. and 600° F.

The article exhibits less than 10 surface pits per square inch when polished to a Number A3 or better surface finish as defined by the Society of Plastics Industries Mold Finish Guide. The article is a hot-isostatically-compacted, heat treated, and fully dense mass of prealloyed particles of a martensitic hot work tool steel consisting essentially of, in weight percent, 0.32 to 0.45 carbon, 0.20 to 2.00 manganese, 0.05 to 0.30 sulfur, up to 0.03 phosphorous. 0.80 to 1.20 silicon, 4.75 to 5.70 chromium, 1.10 to 1.75 molybdenum, 0.80 to 1.20 vanadium, up to 2.00 niobium, balance iron and incidental impurities, as set forth in Table I.

TABLE I

| | |
|---|---|
| Carbon | 0.32–0.45 |
| Manganese | 0.20–2.00 |
| Sulfur | 0.05–0.30, preferably 0.05 to 0.20 |
| Phosphorus | 0.03 max |
| Silicon | 0.80–1.20 |
| Chromium | 4.75–5.70 |
| Molybdenum | 1.10–1.75 |
| Vanadium | 0.80–1.20 |

Alternately, the prealloyed particles may comprise a chemical composition of any AISI hot work tool steel to which sulfur has been added within the range of 0.05 to 0.30 weight percent. In addition, the prealloyed particles may comprise a maraging or precipitation-hardening steel suitable for use as molds for plastic injection molding, die casting die components, and other hot work tooling components, and to which sulfur has been added within the range of 0.05 to 0.30 weight percent.

With the use of prealloyed particles, the sulfur is uniformly distributed therein and thus the resulting sulfides in the hot-isostatically-compacted, fully dense mass of the prealloyed particles are small and uniformly distributed, and most of them are generally spherical. Preferably, the maximum size of the sulfides in the consolidated articles produced in accordance with the invention is less than about 25 microns in their longest dimension. Thus, the segregation of sulfur that is inherent within cast ingots of AISI H13 and other conventional wrought steels is eliminated to in turn avoid the presence of conventional, relatively thick, elongated, sulfide stringers in mold and die blocks forged from these ingots.

The prealloyed particles may be produced by gas atomization of the desired composition with the presence of sulfur within the limits of the invention as defined herein. By the use of gas atomization, spherical particles of the character preferred for use in the practice of the invention are achieved. Nitrogen is the preferred atomizing gas.

In accordance with the invention, a highly machinable, as hot-isostatically-compacted, prehardened, martensitic hot work tool steel mold and die block which may be used for molds for plastic injection molding, die casting die components, and other hot work tooling components is manufactured by hot isostatic compaction of prealloyed particles to full density to form a compact, and heat treatment of the compact. The heat treatment may comprise annealing, hardening by heating and cooling to produce a martensitic structure and subsequent tempering that includes at least a double tempering treatment with intermediate cooling to ambient temperature.

In accordance with a preferred embodiment of the invention, sulfur in a quantity of 0.05 to 0.30 weight percent, preferably 0.05 to 0.20 percent, is added to molten steel of a composition suitable for use in the practice of the invention. The molten steel is then nitrogen-gas atomized to produce prealloyed powder. The powder is loaded into low-carbon steel containers, which are hot outgassed and then sealed by welding. The filled containers are compacted to full density by hot isostatic pressing for up to 12 hours within a temperature range of 1800° to 2400° F. and at a pressure in excess of 10,000 psi. The compacts are annealed by heating to a temperature between 1550° and 1700° F. for about 1 hour per inch of thickness for a minimum of two hours, and cooling to room temperature at a rate less than 50° F. per hour. The annealed compacts are hardened by heating to a temperature between 1800 and 1950° F. for about ½-hour per inch of thickness, and quenching to about 150° F. at a minimum rate of 20° F. per minute to produce a martensitic structure. Upon reaching a temperature of about 150° F., the compacts are immediately double tempered within a temperature range of 1000° to 1200° F. for about 1 hour per inch of thickness and for a minimum of 2 hours plus 2 hours, with cooling to ambient temperature between tempers. Remnants of the low-carbon steel container are removed from the compacts by machining after heat treatment. Mold and die blocks are produced by cutting the compact into blocks of the desired size and shape.

The "AISI hot work tool steels" are defined as and encompass the chromium-molybdenum hot work steels such as H10, H11, and H12 which contain, in weight percent, 0.30 to 0.60 carbon, 0.10 to 2.0 manganese, up to 0.03 phosphorus, 0.30 to 2.0 silicon, 2.0 to 6.0 chromium, 0.20 to 1.50 vanadium, 0.75 to 3.50 molybdenum, up to 2.0 niobium, balance iron and incidental impurities; the chromium-tungsten hot work steels such as H14, H16, H19, and H23, which contain, in weight percent, 0.30 to 0.60 carbon, 0.10 to 2.0 manganese, up to 0.03 phosphorus, 0.30 to 2.0 silicon, 2.0 to 13.0 chromium, 0.20 to 2.50 vanadium, 3.0 to 13.0 tungsten, 0.10 to 2.0 molybdenum, 0.50 to 5.0 cobalt, up to 4.0 niobium, balance iron and incidental impurities; the tungsten hot work steels such as H20, H21, H22, H24, H25, and H26, which contain, in weight percent, 0.20 to 0.60 carbon, 0.10 to 2.0 manganese, up to 0.03 phosphorus, 0.10 to 1.0 silicon, 2.0 to 6.0 chromium, up to 3.0 nickel, 0.10 to 2.0 vanadium, 5.0 to 20.0 tungsten, up to 3.0 molybdenum, up to 4.0 cobalt, up to 3.0 niobium, balance iron and incidental impurities; and the molybdenum hot work steels such as H15, H41, H42, and H43, which contain, in weight percent, 0.10 to 0.70 carbon, 0.10 to 2.0 manganese, 0.10 to 1.0 silicon, 2.0 to 6.0 chromium, up to 3.0 nickel, 0.50 to 3.0 vanadium, up to 8.0 tungsten, 4.0 to 10.0 molybdenum, up to 26.0 cobalt, up to 3.0 niobium, balance iron and incidental impurities.

"Maraging and precipitation-hardening steels" are defined as steels which exhibit a soft, martensitic microstructure after solution annealing, and which are hardened by a subsequent age-hardening treatment. Solution annealing is conducted by heating the steel to a temperature in excess of 1500° F. for about ½-hour per inch of thickness and for a minimum of three hours, and then cooling to ambient temperature at a rate at least equal to that achieved in still air. Age hardening is conducted by heating the steel to a minimum temperature of 900° F. and holding it at that temperature for a minimum time of one hour. Maraging steels and precipitation-hardening steels which are suitable for use as molds for plastic injection molding, die casting die components, and other hot work tooling components consist of, in weight percent, up to 0.20 carbon, up to 1.0 manganese, up to 0.04 phosphorus, up to 0.50 silicon, up to 19.0 nickel, up to 18.0 chromium, up to 8.0 molybdenum, up to 6.0 tungsten, up to 11.0 cobalt, up to 4.0 copper, up to 2.0 niobium, up to 2.0 titanium, up to 2.0 aluminum, balance iron and incidental impurities.

DETAILED DESCRIPTION OF THE PREFERRED EMBODIMENTS

The currently available prehardened hot work tool steel mold and die blocks are made using conventional ingot metallurgy. As such, the steel is melted and is cast into ingot molds to produce ingots which weigh in excess of 1,000 pounds. If the steel contains more than about 0.010 weight percent sulfur, the sulfur segregates toward the center of the ingot and combines with other elements in the steel to form discrete sulfur-rich particles (sulfides) as the molten steel solidifies. The resultant ingot thus contains a nonuniform distribution of sulfur. The sulfide particles are malleable, and when the solidified ingot is subsequently hot forged or hot rolled, they become elongated parallel to the direction of forging and/or rolling. The sulfide stringers so produced become more numerous and thicker with increasing sulfur content in the steel.

Figure 1A:
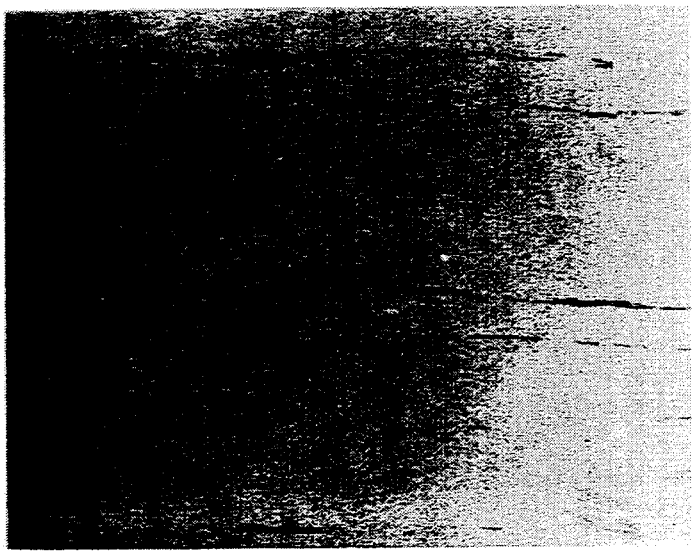
FIGS. 1*a* and 1*b* are photomicrographs at magnifications of 200× and 500×, respectively, showing the microstructure of a commercial, conventionally-produced, prehardened, resulfurized, hot work tool steel mold and die block.
Figure 1B:
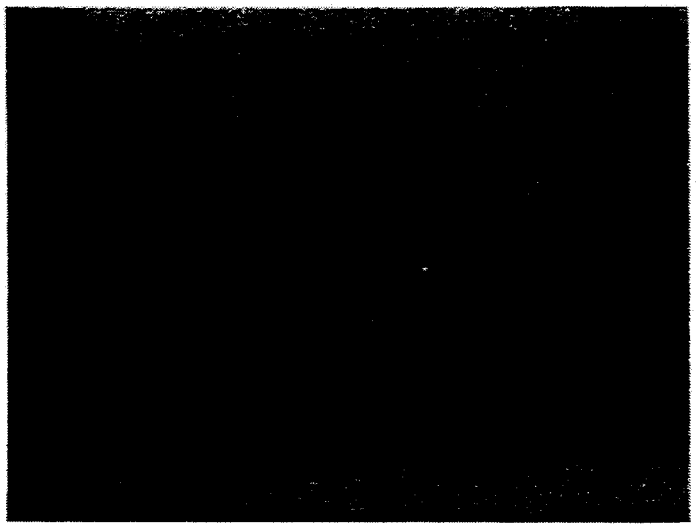
Figure 2A:
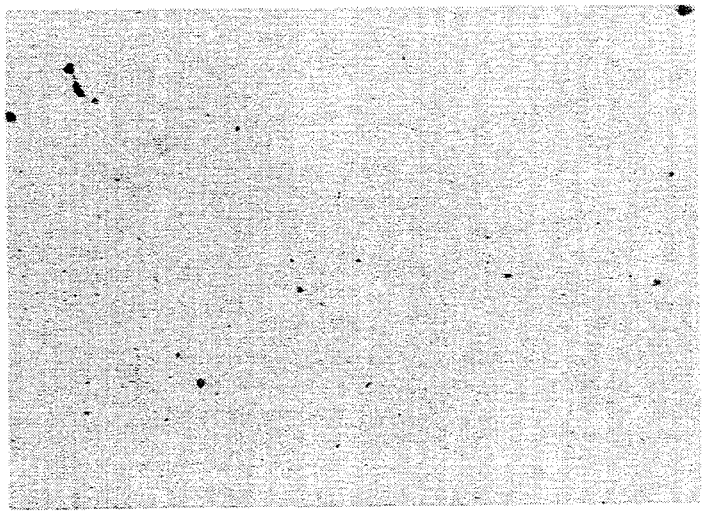
FIGS. 2*a*, 2*b*, and 2*c* are photomicrographs at a magnification of 500× showing the microstructure of hot work tool steel mold and die blocks in accordance with the invention with sulfur contents of 0.075%, 0.15%, and 0.30%, respectively.
Figure 2B:
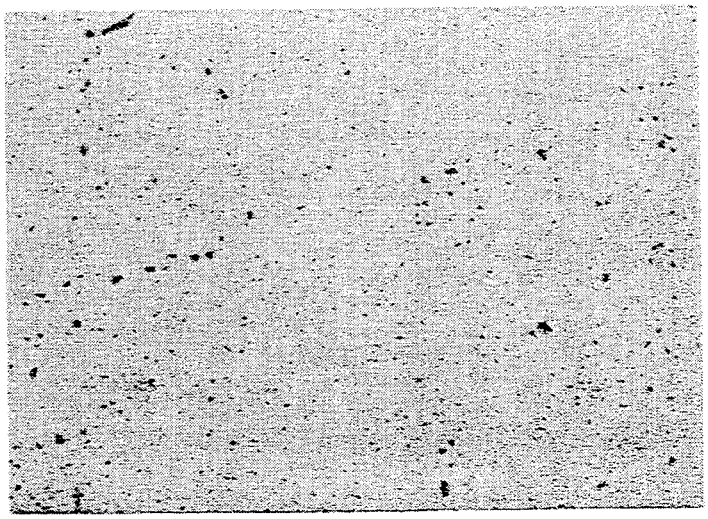
Figure 2C:
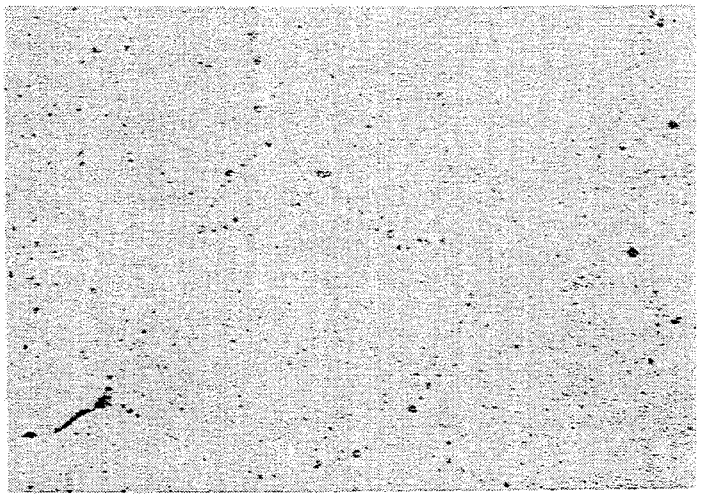

For prehardened hot work tool steel mold and die blocks, a sulfur content of about 0.10 weight percent or more is necessary to make the steel machinable by conventional chip-making methods at the relatively high hardness needed for plastic injection molding and hot work tooling applications (35 to 50 HRC). At this sulfur level, the sulfide stringers which form in the die blocks are both very numerous and very thick, as evidenced by FIG. 1. FIGS. 1*a* and 1*b* are photomicrographs of the microstructure of a commercial, conventional, prehardened hot work tool steel mold and die block. It is the presence of these numerous sulfides that results in the high machinability of the hardened mold and die block, but their length, width, and shape causes a reduction in the impact toughness and polishability of components manufactured from such a mold and die block.

To eliminate the nonuniform distribution and minimize the size of the sulfide particles, and thereby minimize their negative effects on impact toughness and polishability, the mold and die blocks can be made by hot isostatic compaction and heat treatment of prealloyed powder which contains the high sulfur level necessary for good machinability in the hardened condition. The method of manufacture in accordance with the invention eliminates the cost, manpower, and energy consumption required by thermomechanical treatments such as hot forging, hot rolling, and hot extrusion, and results in a substantial improvement in the isotropy of the mechanical and technological properties of the resultant mold and die blocks. In addition, the method of manufacture in accordance with the invention permits the manufacture of near-net-shape mold and die blocks which result in reductions in the costs, manpower, and energy consumption required to machine the mold and die blocks to finished size and shape. Further, using the method of manufacture in accordance with the invention, sulfur levels even higher than that of the currently available, conventional, prehardened, hot work tool steel mold and die blocks may be used without degrading polishability or reducing the notch toughness to a level below that of the commercial, conventional, prehardened hot work tool steel mold and die blocks.

To demonstrate the principles of the invention, a series of experimental hot work tool steel mold and die blocks were made and subjected to machinability, mechanical, and polishability tests. A hot-isostatically-compacted, hot work tool steel mold and die block with a chemical composition outside the scope of the invention was included in the series of experimental mold and die blocks. A commercial, conventional, prehardened, hot work tool steel mold and die block was subjected to the same tests for comparison. The chemical compositions of the experimental die blocks and the commercial, conventional, prehardened mold and die block are given in Table II.

TABLE II

| | | COMPOSITIONS OF PREHARDENED MOLD AND DIE BLOCK STEELS, IN WEIGHT % | | | | | | | | | |
|---|---|---|---|---|---|---|---|---|---|---|---|
| Grade | Block Number | C | Mn | P | S | Si | Sr | Mo | V | O | N |
| H13 | 91-121 | 0.35 | 0.31 | 0.011 | 0.075 | 0.96 | 5.51 | 1.32 | 0.95 | 0.0100 | 0.023 |
| H13 | 91-122 | 0.35 | 0.34 | 0.008 | 0.15 | 0.99 | 5.70 | 1.29 | 0.99 | 0.0102 | 0.026 |
| H13 | 91-123 | 0.38 | 0.85 | 0.006 | 0.30 | 1.05 | 4.97 | 1.33 | 1.05 | 0.0042 | 0.007 |
| H13[1] | 678-173 | 0.39 | 0.35 | 0.017 | 0.004 | 1.01 | 5.28 | 1.30 | 1.02 | 0.0033 | 0.043 |

TABLE II-continued

| Grade | Block Number | C | Mn | P | S | Si | Sr | Mo | V | O | N |
|---|---|---|---|---|---|---|---|---|---|---|---|
| | | COMPOSITIONS OF PREHARDENED MOLD AND DIE BLOCK STEELS, IN WEIGHT % | | | | | | | | | |
| H13[2] | 90-64 | 0.38 | 0.72 | 0.020 | 0.14 | 0.94 | 5.20 | 1.36 | .06 | — | — |
| H11 | 92-44 | 0.35 | 0.38 | — | 0.15 | 0.99 | 5.14 | 1.42 | 0.51 | 0.0080 | 0.003 |
| H10 | 92-45 | 0.42 | 0.63 | 0.014 | 0.16 | 0.98 | 3.33 | 2.62 | 0.37 | 0.0070 | 0.002 |
| H10 | 92-45 | 0.42 | 0.89 | 0.014 | 0.27 | 1.03 | 3.35 | 2.63 | 0.39 | 0.0180 | 0.004 |

[1]Non-Resulfurized, Prehardened Mold and Die Block
[2]Commercial, Conventional, Prehardened Mold and Die Block The experimental mold and die blocks were made from 100-pound induction-melted heats which were nitrogen gas atomized to produce prealloyed powder. Powder from each heat was screened to a −16 mesh size (U.S. Standard) and was loaded into a 4½-inch diameter by 8-inch long low-carbon steel container. Each container was hot outgassed and was sealed by welding. The compacts were hot isostatically compacted for 4 hours at 2165° F. and 14,500 psi and were cooled to ambient temperature.

Several tests were conducted to compare the advantages of the mold and die blocks of the invention with those of a currently available, commercial, conventional, prehardened mold and die block, and to demonstrate the significance of their composition and method of manufacture. Tests were conducted to illustrate the effects of composition and method of manufacture on microstructure, machinability, impact toughness, and polishability. Specimens for the various laboratory tests were cut from the compacts of the invention and were hardened. The H13 and H11 specimens were hardened by austenitizing for 30 minutes at 1875° F. and forced-air quenching to about 150° F. They were then double tempered for 2 hours plus 2 hours at 1120° F. The H10 specimens were hardened by austenitizing for 30 minutes at 1875° F. and oil quenching to about 150° F. They were then double tempered for 2 hours plus 2 hours at 1165° F. All test specimens were finish machined after heat treatment. Specimens from the commercial, conventional, prehardened, hot work tool steel mold and die block were cut and finish machined directly from the block.

Figure 3A:
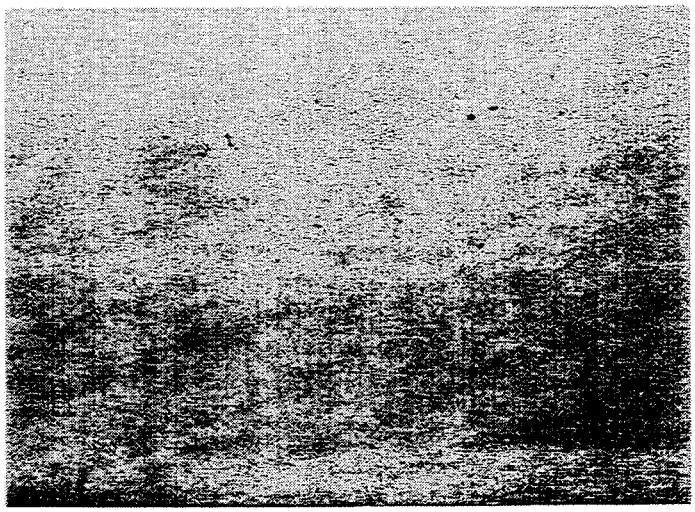
FIGS. 3*a*, 3*b*, and 3*c* are photomicrographs at a magnification of 200× showing that the maximum size of the sulfide particles in the hot work tool steel mold and die blocks in accordance with the invention is less than 25 microns.
Figure 3B:
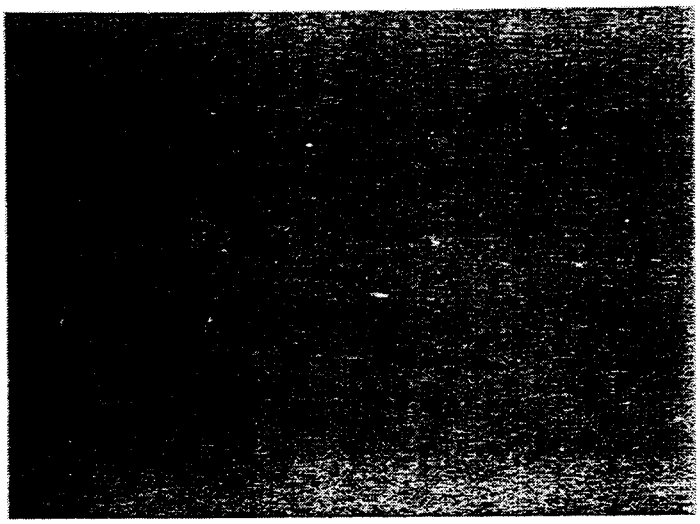
Figure 3C:
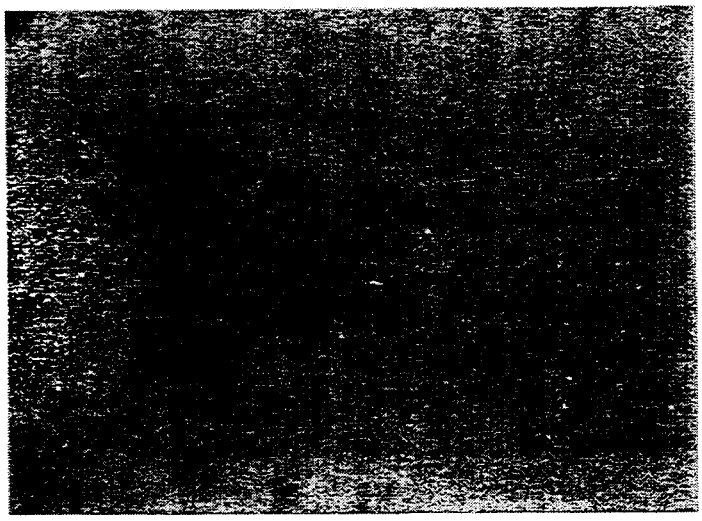
Figures 2, 6A:
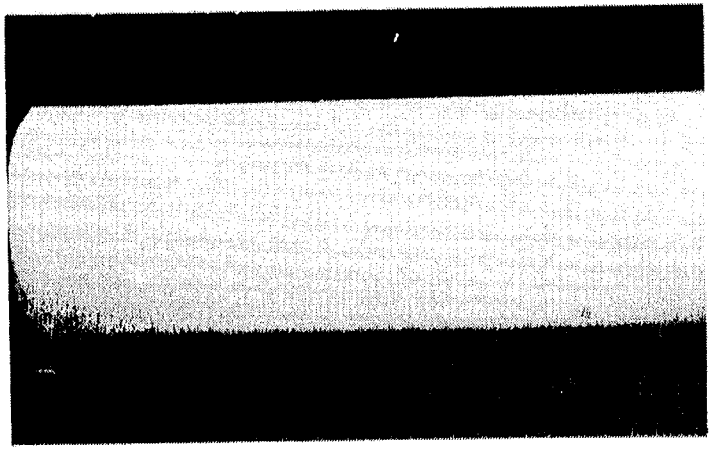
FIGS. 6*a*, 6*b*, and 6*c* are dark field and bright field photographs at a magnification of 3.5× showing the results of polishability evaluations on a sample of a conventional hot work tool steel mold and die block, and samples in accordance with the invention.
Figures 1, 6A:
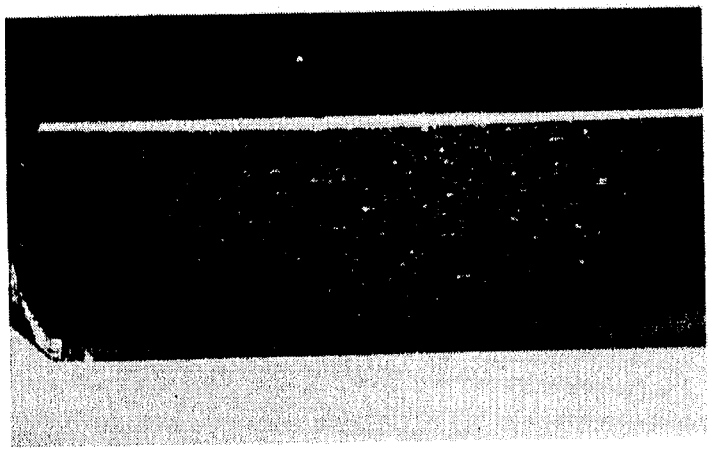
Figures 2, 6B:
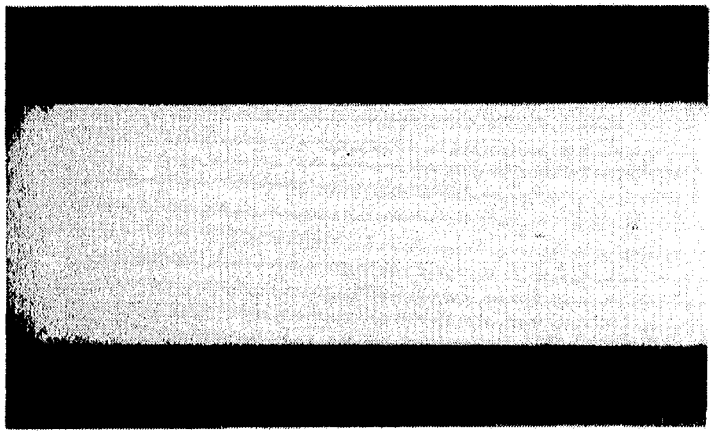
Figures 1, 6B:
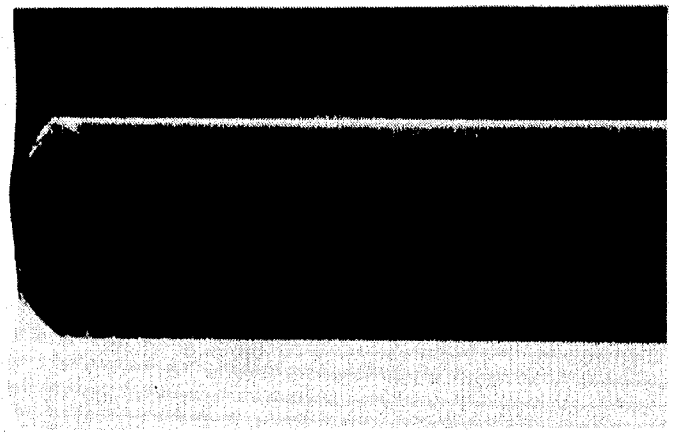
Figures 2, 6C:
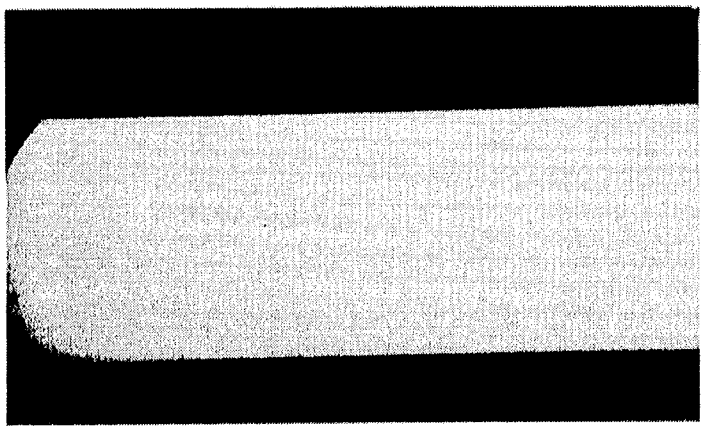
Figures 1, 6C:
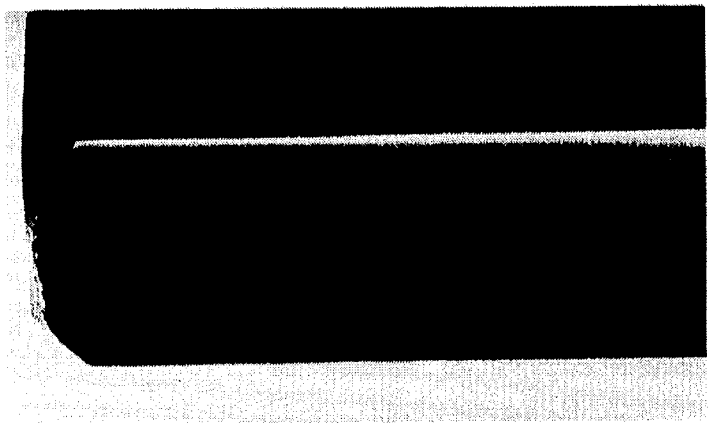

The microstructures of the mold and die blocks of the invention are presented in FIGS. 2 and 3. Comparison with the microstructure of the commercial, conventional, prehardened mold and die block shown in FIG. 1 shows that the sulfides in the mold and die blocks of the invention are smaller, more uniformly distributed, and are generally more spherical in shape. FIG. 3 shows that the sulfides in the mold and die blocks of the invention are all less than 25 microns in their longest dimension.

Figure 4:
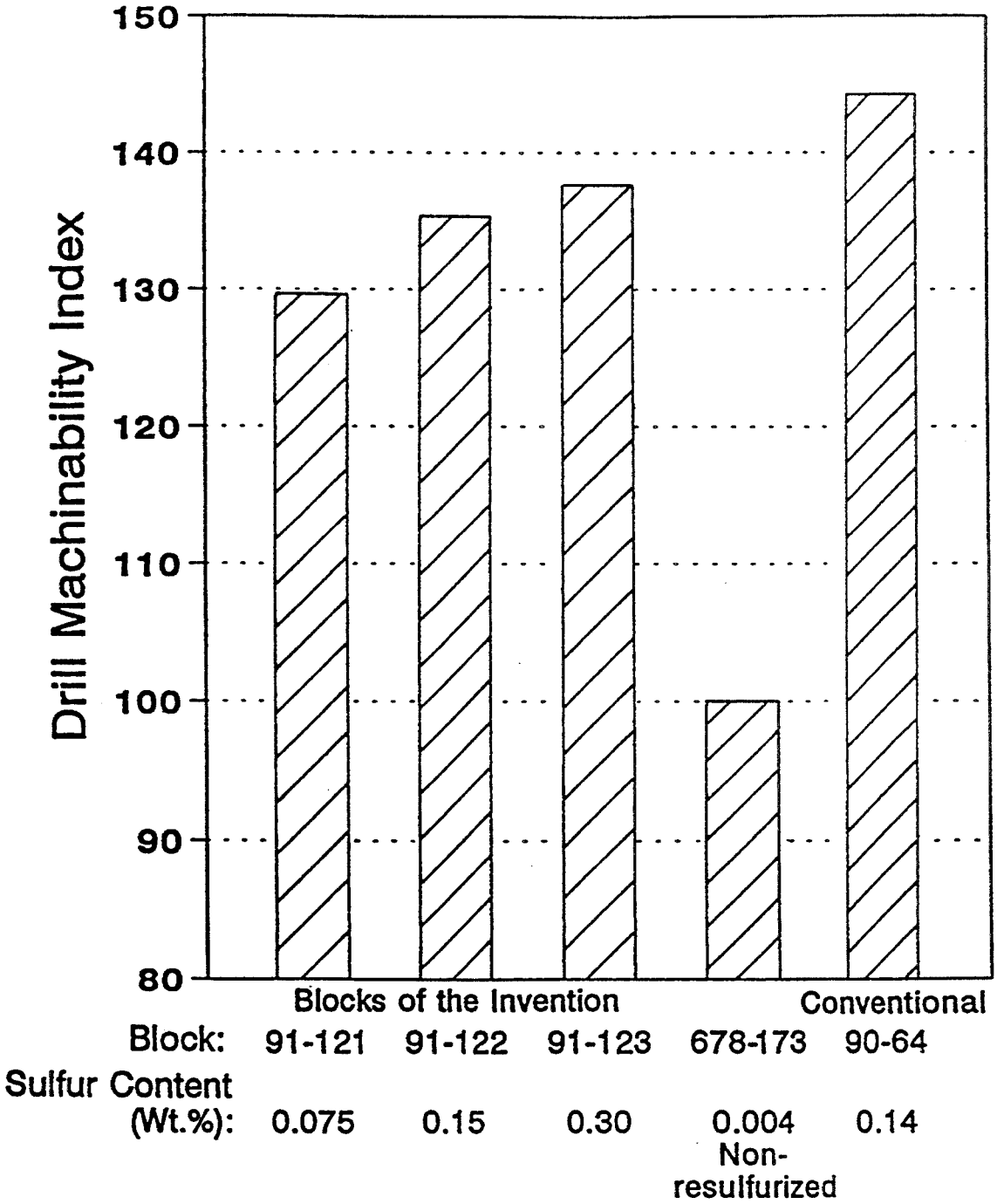
FIG. 4 is a graph showing the results of drill machinability tests on samples of a hot-isostatically-compacted, non-resulfurized hot work tool steel mold and die block and samples in accordance with the invention.

The results of drill machinability tests conducted on the experimental mold and die blocks and on the commercial, conventional, prehardened mold and die block are given in Table III and in FIG. 4.

TABLE III

Drill Machinability Indexes for Mold and Die Blocks of the Invention, a Non-resulfurized Mold and Die Block, and a Conventional, Prehardened Mold and Die Block

| Block Number | Wt. % Sulfur | Hardness Rockwell C | Drill Machinability Index Test Values | Avg. |
|---|---|---|---|---|
| 91-121 | 0.075 | 45 | 124, 113, 152 | 129.6 |
| 92-122 | .0.15 | 45 | 125, 118, 163 | 135.3 |
| 91-123 | 0.30 | 45 | 135, 119, 159 | 137.6 |
| Non-Resulfurized 678-173 | 0.004 | 45.5 | Test Standard | 100 |
| Conventional 90-64 | 0.14 | 44.5 | 136, 124, 173 | 144.3 |

The machinability indexes given in this table and figure were obtained by comparing the times required to drill holes of the same size and depth in the experimental mold and die blocks and in the commercial, conventional, prehardened die block and by multiplying the ratios of these times by 100. The non-resulfurized, hot-isostatically-compacted mold and die block (Block 678-173) was used as the standard in this test, and as such, was assigned a drill machinability index of 100. Indexes greater than 100 indicate that the drill machinability of the test specimen is greater than that of the test standard. The results demonstrate that the mold and die blocks of the invention are highly machinable, as evidenced by their substantially superior drill machinability compared to the test standard. The mold and die blocks of the invention exhibit drill machinability indexes that are not quite as high as that of the commercial, conventional, prehardened mold and die block (Block 90-64) because the sulfide particles in the conventional mold and die block are much larger.

Figure 5:
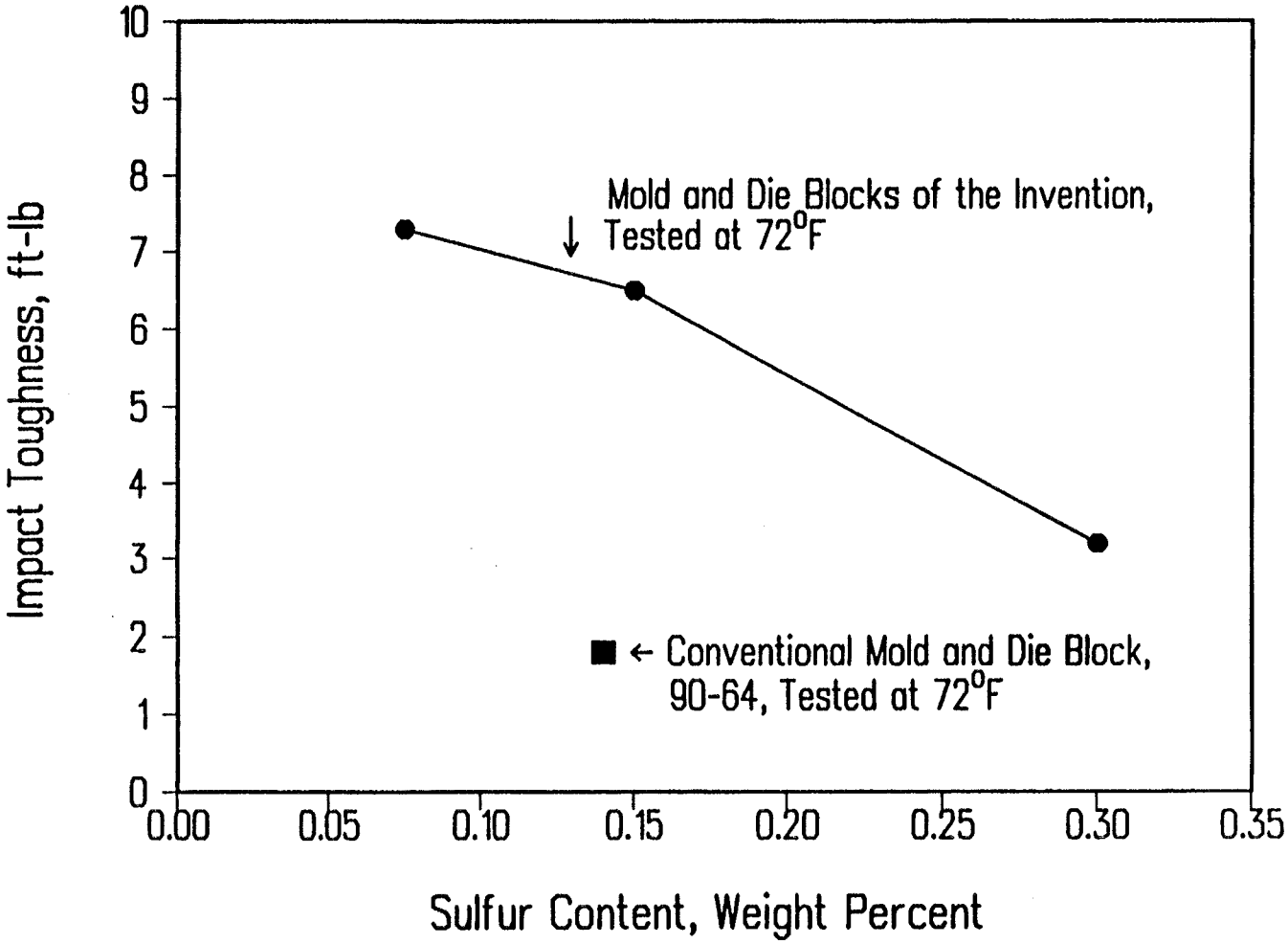
FIG. 5 is a graph showing the results of Charpy V-notch impact tests on samples of a conventional hot work tool steel mold and die block and samples in accordance with the invention.

The results of impact tests conducted on the experimental mold and die blocks and on the commercial, conventional, prehardened mold and die block are given in Table IV and in FIG. 5.

TABLE IV

Notch Toughness of Mold and Die Blocks of the Invention, a Non-resulfurized Mold and Die Block, and a Commercial Conventional, Prehardened Mold and Die Block

| Grade | Block Number | Wt. % Sulfur | Hardness Rockwell C | Orientation | Charpy V-Notch Impact Toughness, ft-lb 72° F. Test Values | Avg. | 600° F. Test Values | Avg. |
|---|---|---|---|---|---|---|---|---|
| H13 | 91-121 | 0.075 | 45 | As-compacted | 7.5, 7, 7.5 | 7.3 | 7, 7, 8.5 | 7.5 |
| H13 | 91-122 | 0.15 | 45 | As-compacted | 5, 6.5, 8 | 6.5 | 6, 7, 7 | 6.7 |
| H13 | 91-123 | 0.30 | 45 | As-compacted | 3.5. 3, 3 | 3.2 | 3, 3, 3 | 3.0 |
| Non-resulfurized H13 | 678-173 | 0.004 | 45 | As-compacted | 6, 5 | 5.5 | | |
| Conventional H13 | 90-64 | 0.14 | 44.5 | Transverse | 2, 2, 1.5 | 1.8 | 2, 2, 2 | 2.0 |
| H11 | 92-44 | 0.15 | 45 | As-compacted | 7, 7.5 | 7.3 | 6, 6.5 | 6.3 |
| H10 | 92-45 | 0.16 | 45 | As-compacted | 5.5, 6 | 5.8 | 5.5, 5.5 | 5.5 |

TABLE IV-continued

Notch Toughness of Mold and Die Blocks of the Invention, a Non-resulfurized Mold and Die Block, and a Commercial Conventional, Prehardened Mold and Die Block

| Grade | Block Number | Wt. % Sulfur | Hardness Rockwell C | Orientation | Charpy V-Notch Impact Toughness, ft-lb 72° F. Test Values | 72° F. Avg. | 600° F. Test Values | 600° F. Avg. |
|---|---|---|---|---|---|---|---|---|
| H10 | 92-46 | 0.27 | 45 | As-compacted | 4, 4.5 | 4.3 | 4, 4 | 4.0 |

These test results show that the sulfur contents in the mold and die blocks of the invention do not substantially degrade the notch toughness, as measured by the Charpy V-notch impact test, compared to that of the non-resulfurized, hot-isostatically-compacted mold and die block (Block 678-173). More significantly, the notch toughnesses of the mold and die blocks of the invention are superior to that of the commercial, conventional, prehardened, hot work tool steel mold and die block (Block 90-64). Impact specimens having a transverse orientation with respect to the grain orientation in the commercial, conventional, prehardened mold and die block were tested because the transverse orientation traditionally exhibits the lowest notch toughness, and as such, the greatest propensity for catastrophic failure in tooling components. By definition, hot-isostatically-compacted compacts do not have longitudinal and transverse orientations with respect to grain orientation and the direction of hot forging, rolling, or extrusion. The tests conducted at 600° F. simulate the service temperature experienced by die components in the die casting of aluminum alloys.

FIG. 5 shows the effect of increasing sulfur content on the room temperature notch toughness of mold and die blocks of the invention in comparison with the notch toughness of the commercial, conventional, prehardened mold and die block. As shown, increasing the sulfur content decreases notch toughness in the mold and die blocks of the invention, but the invention permits a threefold improvement in notch toughness at essentially the same sulfur content as that of the commercial, conventional, prehardened mold and die block. To maintain notch toughness at a level at or above about 5 foot pounds, the preferred range for the sulfur content in the mold and die blocks of the invention is 0.05 to 0.20 weight percent.

Prehardened, resulfurized mold and die blocks made from AISI H11 and AISI H10 are not commercially available. Therefore, samples of these mold and die blocks are not available for direct comparison with the mold and die blocks of the invention. The impact test data in Table IV for hot-isostatically-compacted, heat-treated mold and die blocks of the invention that are based upon the AISI H11 and AISI H10 compositions show that when the principles of the invention are applied to these steels, the resultant notch toughness is superior to that of the commercial, prehardened mold and die block made from AISI H13 hot work steel. The addition of sulfur to conventionally-produced AISI H11, AISI H10, other AISI hot work tool steels, and maraging or precipitation-hardening steels would be expected to result in the same deleterious effects upon notch toughness and polishability as those caused by sulfur additions in conventionally-produced AISI H13 because the ingot segregation and the formation and morphology of the sulfide particles would be similar in conventional mold and die blocks made from all of these materials. Thus, the test data for the mold and die blocks of the invention which are based upon the compositions of AISI H11 and AISI H10 hot work steels demonstrate that the principles of the invention are applicable to all of the AISI hot work tool steels and the maraging or precipitation-hardening steels suitable for use as molds for plastic injection molding, die casting die components, and other hot work tooling components.

The results of polishability evaluations performed on mold and die blocks of the invention and on a commercial, conventional, prehardened mold and die block are presented in FIG. 6. The photographs in the figure show the extent of surface pitting which occurred as the specimens were polished with diamond paste to an A3 or better surface finish as defined by the Society of Plastics Industries (SPI) Mold Finish Guide. The evaluation is performed by grinding, rough polishing, and finish polishing the surface of the specimen, and examining the extent of surface pitting on the resultant surface. Grinding is performed on silicon carbide abrasive paper successively through grit sizes of 120, 240, 380, 500, and 600 mesh. Rough polishing consists of 100 revolutions under an applied load of approximately 10 pounds on a linen-covered polishing wheel impregnated with 6-micron diamond paste and rotating at approximately 400 revolutions per minute. Finish polishing consists of 50 revolutions under an applied load of approximately 10 pounds on a linen-covered polishing wheel impregnated with 1-micron diamond paste and rotating at approximately 400 revolutions per minute. The darkfield and brightfield photographs of the polished surfaces in FIG. 6*a* show that the commercial, conventional, prehardened mold and die block exhibit extensive surface pitting as a result of the large size and shape of the sulfide stringers in the steel. Conversely, the darkfield and brightfield photographs in FIGS. 6*b* and 6c show that mold and die blocks of the invention which have sulfur contents which are higher than that of the commercial, conventional, prehardened mold and die block exhibit essentially no pits in the polished surfaces.

The superior impact toughness and polishability exhibited by mold and die blocks of the invention is attributed to the fact that the sulfides which exist in the mold and die blocks of the invention are smaller and more uniformly distributed through the material compared to those in the commercial, conventional prehardened mold and die block. The maximum size of the sulfides in the mold and die blocks of the invention is less than 25 microns in their longest dimension. While the sulfides in the mold and die blocks of the invention which are discussed in the present disclosure are primarily manganese sulfides, it is known that other sulfide-forming elements, such as titanium and calcium, can be used to alter the composition and hardness of the sulfide particles which form in the steel. As such, the use of other sulfide-forming elements in hot-isostatically-compacted, prehardened mold and die blocks is considered to be within the scope of the invention.

Similarly, it is known that the elements nitrogen and niobium can be substituted for the elements carbon and vanadium, respectively, in many hot work tool steel compositions, and as such, such substitutions in hot-isostatically-compacted, prehardened mold and die blocks are considered within the scope of the invention.

The term "as hot-isostatically-compacted" as used herein means that no thermomechanical treatment has been applied after hot-isostatic compacting.

All percentages are in weight percent unless otherwise indicated.

What is claimed:

1. A martensitic hot work tool steel mold and die block article adapted for use in the manufacture of molds for plastic injection molding, die casting die components, and other hot work tooling components, said article having a hardness within the range of 35 to 50 HRC, a minimum Charpy V-notch impact toughness of 3 foot-pounds when heat treated to a hardness of 44 to 46 HRC and when tested at both 72° F. and 600° F., said article comprising an as hot-isostatically-compacted, fully dense, heat-treated mass of prealloyed particles which contains sulfur within the range of 0.05 to 0.30 weight percent.

2. A martensitic hot work tool steel mold and die block article adapted for use in the manufacture of molds for plastic injection molding, die casting die components, and other hot work tooling components, said article having a hardness within the range of 35 to 50 HRC, a minimum Charpy V-notch impact toughness of 3 foot-pounds when heat treated to a hardness of 44 to 46 HRC and when tested at both 72° F. and 600° F., said article comprising an as hot-isostatically-compacted, fully dense, heat-treated mass of prealloyed particles consisting essentially of, in weight percent, 0.32 to 0.45 carbon, 0.20 to 2.00 manganese, 0.05 to 0.30 sulfur, up to 0.03 phosphorus, 0.80 to 1.20 silicon, 4.7 to 5.70 chromium, 1.10 to 1.75 molybdenum, 0.80 to 1.20 vanadium, up to 2.00 niobium, balance iron and incidental impurities.

3. A hot-isostatically-compacted martensitic hot work tool steel mold and die block article adapted for use in the manufacture of molds for plastic injection molding, die casting die components, and other hot work tooling components, said article having a hardness within the range of 35 to 50 HRC, a minimum Charpy V-notch impact toughness of 3 foot-pounds when heat treated to a hardness of 44 to 46 HRC and when tested at both 72° F. and 600° F., said article comprising an as hot-isostatically-compacted, fully dense, heat-treated mass of prealloyed particles comprising a chemical composition of any AISI hot work tool steel to which sulfur has been added within the range of 0.05 to 0.30 weight percent.

4. A hot-isostatically-compacted martensitic hot work tool steel mold and die block article adapted for use in the manufacture of molds for plastic injection molding, die casting die components, and other hot work tooling components, said article having a hardness within the range of 35 to 50 HRC, a minimum Charpy V-notch impact toughness of 3 foot-pounds when heat treated to a hardness of 44 to 46 HRC and when tested at both 72° F. and 600° F. said article comprising an as hot-isostatically-compacted, fully dense, heat-treated mass of prealloyed particles comprising a chemical composition of a maraging or precipitation-hardening steel which is suitable for use as molds for plastic injection molding, die casting die components, and other hot work tooling components and to which sulfur has been added within the range of 0.05 to 0.30 weight percent.

5. A hot-isostatically-compacted martensitic steel mold and die block article of claims 1, 2, 3, or 4, which exhibits a minimum Charpy V-notch impact toughness of 5 foot pounds when heat treated to a hardness of 44 to 46 HRC and when tested at both 72° F. and 600° F., and which contains sulfur within the range of 0.05 to 0.20 weight percent.

6. A hot-isostatically-compacted martensitic steel mold and die block article of claims 1, 2, 3, or 4 which exhibits a maximum of 10 surface pits per square inch when polished to an A3 or better surface finish as defined by the Society of Plastics Industries Mold Finish Guide.

7. A hot-isostatically-compacted martensitic steel mold and die block article of claims 1, 2, 3, or 4 in which the article contains sulfide particles of a maximum size of 25 microns in their longest dimension.

8. A method for manufacturing a martensitic hot work tool steel die block article adapted for use in the manufacture of die casting die components and other hot work tooling components, the article having a hardness within the range of 35 to 50 HRC, and a minimum transverse Charpy V-notch impact toughness of 3 foot pounds when heat treated to a hardness of 44 to 46 HRC and when tested at both 72° F. and 600° F., with the article comprising an as hot-isostatically-compacted, heat treated and fully dense consolidated mass of prealloyed particles, consisting essentially of, in weight percent, 0.32 to 0.45 carbon, 0.20 to 2.00 manganese, 0.05 to 0.30 sulfur, up to 0.03 phosphorous, 0.80 to 1.20 silicon, 4.75 to 5.70 chromium, 1.10 to 1.75 molybdenum, 0.80 to 1.20 vanadium, balance iron and incidental impurities;

said method comprising producing said prealloyed particles by gas atomization, hot isostatically compacting the prealloyed particles to full density to form a compact and absent thermomechanical treatment of said compact, annealing said compact, hardening said compact by heating and cooling to produce a martensitic structure, and tempering said compact, which tempering includes at least a double tempering treatment with intermediate cooling to ambient temperature.

9. A method for manufacturing a martensitic hot work steel die block article adapted for use in the manufacture of die casting die components and other hot work tooling components, the article having a hardness within the range of 35 to 50 HRC and a minimum transverse Charpy V-notch impact toughness of 3 foot pounds when heat treated to a hardness of 44 to 46 HRC and when tested both at 72° F. and 600° F., with the article comprising an as hot-isostatically-compacted, heat treated and fully dense consolidated mass of prealloyed particles, comprising a chemical composition of wrought AISI hot work tool steel to which sulfur has been added within the range of 0.05 to 0.30 weight percent;

said method comprising producing said prealloyed particles by gas atomization, hot isostatically compacting the prealloyed particles to full density to form a compact and absent thermomechanical treatment of said compact, annealing said compact, hardening said compact by heating and cooling to produce a martensitic structure, and tempering said compact, which tempering includes at least a double tempering treatment with intermediate cooling to ambient temperature.

10. A method for manufacturing a màrtensitic die steel article adapted for use in the manufacture of die casting die components and other hot work tool tooling components, the article having a hardness within the range of 35 to 55 HRC and a minimum transverse Charpy V-notch impact toughness of 3 foot pounds when heat treated to a hardness of 44 to 46 HRC and when tested at both 72° F. and 600° F., the article comprises an as hot-isostatically-compacted, heat treated and fully dense consolidated mass of prealloyed particles comprising a chemical composition of a maraging or precipitation-hardening steel suitable for use as die casting die components and other hot work tooling components and to which sulfur has been added within the range of 0.05 to 0.30 weight percent;

said method comprising producing said prealloyed particles by gas atomization, hot isostatically compacting the prealloyed particles to full density to form a compact, and absent thermomechanical treatment of said compact, solution annealing said article to produce a martensitic structure, and age hardening said article to working hardness by heat treating and cooling.

11. The method of claims 8, 9 or 10 in which the article contains sulfide particles having a maximum size of 25 microns in the longest direction thereof.

12. The method of claims 8, 9, or 10 in which the sulfur content is within the range of 0.05 to 0.20% and the minimum Charpy V-notch impact toughness is 5 foot pounds.

13. The method of claims 8 or 9 wherein the hot isostatic compaction is conducted for up to 12 hours within a temperature range of 1800° F. to 2400° F., and at a pressure in excess of 10,000 psi and said hardening is conducted by heating to a temperature between 1800° F. and 1950° F. for about ½ hour per inch of thickness of said article, and quenching to about 150° F. at a minimum rate of 20° F. per minute to produce a martensitic structure and upon reaching a temperature of 150° F. double tempering within a temperature range of 1000° F. to 1200° F. for about 1 hour per inch of thickness and for a minimum of 2 hours plus 2 hours, with cooling to ambient temperature between tempers.

14. The method of claim 10 wherein the hot isostatic compaction is conducted for up to 12 hours within a temperature range of 1800° F. to 2400° F., and at a pressure in excess of 10,000 psi, and said solution annealing is conducted by heating to a temperature in excess of 1500° F. for about ½-hour per inch of thickness of said article and a minimum of three hours, with cooling to ambient temperature at a rate at least equal to that achieved in still air, and said age hardening is by heating to a minimum temperature of 900° F. and holding at said temperature for a minimum time of one hour.

* * * * *